US007625095B1

(12) United States Patent
Ohs

(10) Patent No.: US 7,625,095 B1
(45) Date of Patent: Dec. 1, 2009

(54) MULTI-PURPOSE HOLIDAY DISPLAY LIGHT BOX

(76) Inventor: Barry W. Ohs, 10 Dunham Rd., Billerica, MA (US) 01821

( * ) Notice: Subject to any disclaimer, the term of this patent is extended or adjusted under 35 U.S.C. 154(b) by 78 days.

(21) Appl. No.: 11/853,266

(22) Filed: Sep. 11, 2007

(51) Int. Cl.
*A47F 11/10* (2006.01)

(52) U.S. Cl. ..... 362/125; 362/374; 362/222; 362/806; 362/808; 362/812; 40/480; 40/502; 40/541

(58) Field of Classification Search ..... 362/125, 362/222, 260, 396, 374, 375, 806, 808, 812; 40/480, 502, 541
See application file for complete search history.

(56) References Cited

U.S. PATENT DOCUMENTS

| | | | | |
|---|---|---|---|---|
| 1,861,920 | A * | 6/1932 | Holman | 40/576 |
| 6,060,838 | A * | 5/2000 | Cantoni et al. | 315/159 |
| 2006/0117625 | A1* | 6/2006 | Peterson | 40/611.01 |
| 2008/0117632 | A1* | 5/2008 | Li | 362/252 |

* cited by examiner

*Primary Examiner*—Jacob Y Choi

(57) ABSTRACT

A multi-purpose holiday display light box that is equipped with an interchangeable holiday indicia for use as a lawn ornament or decoration.

7 Claims, 6 Drawing Sheets

MULTI-PURPOSE HOLIDAY DISPLAY LIGHT BOX

FIELD OF THE INVENTION

The present invention generally relates to a lawn ornament and more particularly, relates to a multi-purpose holiday display light box for use as a lawn ornament.

BACKGROUND OF THE INVENTION

Lawn ornaments are frequently used by homeowners during the holiday seasons for improving the holiday spirit. The most celebrated holidays are Christmas, Easter, Halloween, Thanksgiving and Valentine's Day. Various lawn ornaments have been available including those which are blown-up balloon figures for Santa Clause, Snowmen, etc. Some of those blown-up balloon figures may even be provided with illumination installed inside the balloon figure for nighttime viewing of the figures or characters. Since numerous holidays are celebrated by many people, to provide a holiday indicia for each holiday would be extremely tedious, costly, and difficult to store during the rest of the year when the holiday passes. None of the commercially available holiday indicia's presently available is of the multi-purpose nature in that, they can only be used for a certain holiday and not for other holidays. It is therefore desirable to provide a multi-purpose holiday display light box that can be versatilly used throughout the year.

It is therefore an object of the present invention to provide a holiday display light box as a lawn decoration without the drawbacks or shortcomings of the conventional display light boxes.

It is another object of the present invention to provide a multi-purpose holiday display light box that can be used year round for different holidays.

SUMMARY OF THE INVENTION

In accordance with the present invention, a multi-purpose holiday display light box for use as a lawn decoration is provided.

In a preferred embodiment, a multi-purpose holiday display light box can be constructed of an elongated box body that has four side panels and a bottom panel forming a cavity therein and an open top; an illumination source mounted in the cavity; at least three sections of a holiday indicia generally representing a head portion, an upper body portion and a lower body portion each formed of an at least partially light transmitting plastic material and each is removably mounted to the box body to completely conceal the open top of the box body.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a multi-purpose holiday display light box that can be used advantageously as a lawn ornament or decoration.

The present invention multi-purpose holiday display light box is a versatile lawn ornament that provides an illuminated display for various holidays. It provides an eye-catching decoration that can enliven the home throughout the year for Christmas, Halloween, Easter, etc. The holiday display light box consists of a rectangular, wood or plastic box that taper in slightly towards the top. Contained within the interior of the box is a light fixture that can be powered through the inclusion of a standard outdoor electrical cord containing a male plug. The decoration can feature interchangeable fronts, i.e. holiday indicia, that can be produced in colors and shapes designed to accommodate the various holidays. Included are a snowman for Christmas, a bunny for Easter and a jack-o-lantern for Halloween. The front section of the decoration can simply be changed for various holidays. The present invention holiday display light box measures approximately 21 inches long, 21 inches wide, with a height of approximately 55 inches.

The present invention multi-purpose holiday display light box fulfills the need for a versatile, economical, and timesaving means to decorate the exterior of a home for various holidays. The appealing features of the present invention holiday display light box are its convenience, practically and ability to save decorators time as well as money. This lawn ornament or decoration can be accompanied by various front sections that would allow it to be displayed for the various holidays and thus improving the holiday spirit.

Figure 1:
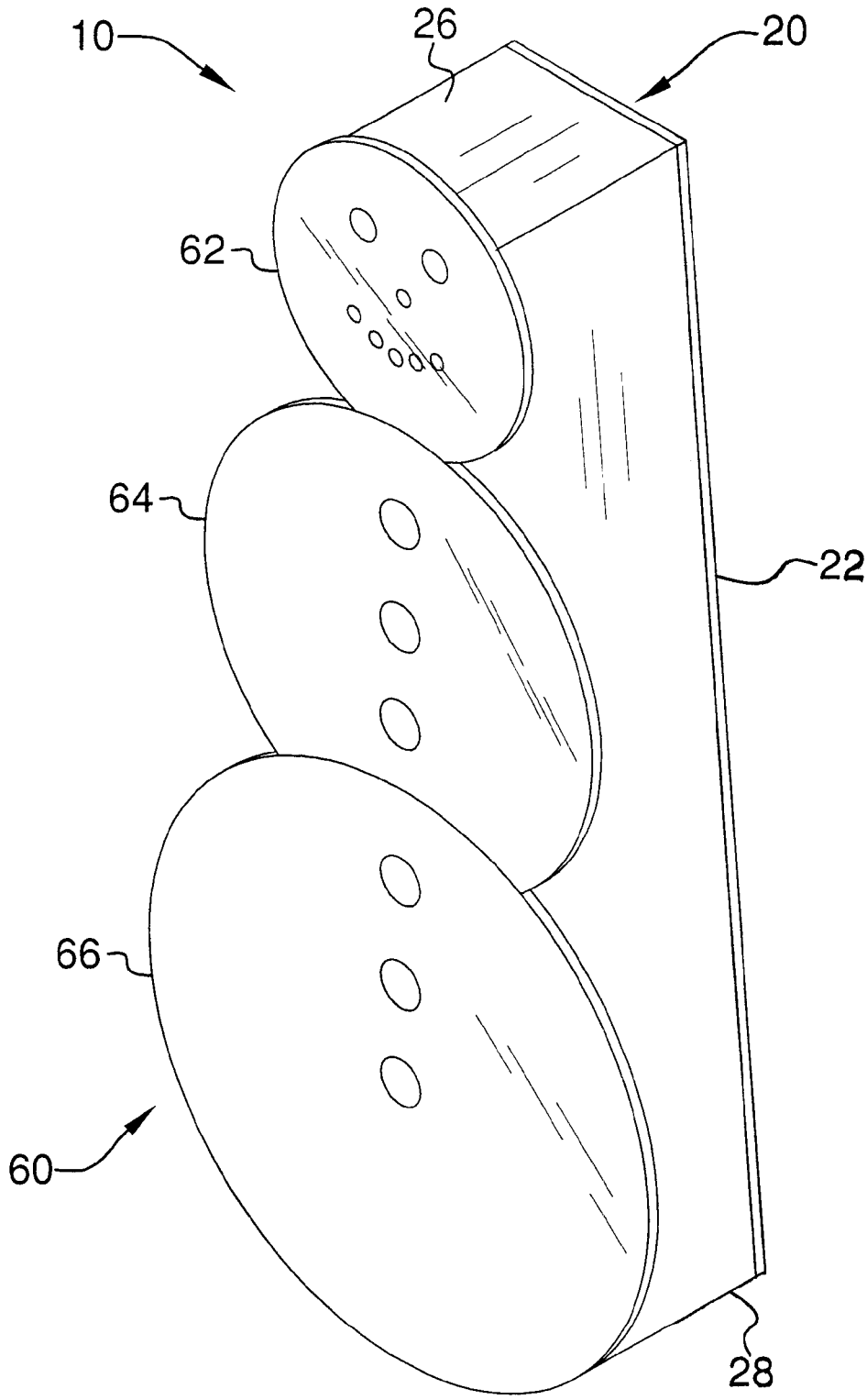
FIG. 1 is a perspective view of the present invention multi-purpose holiday display light box.
Figure 3:
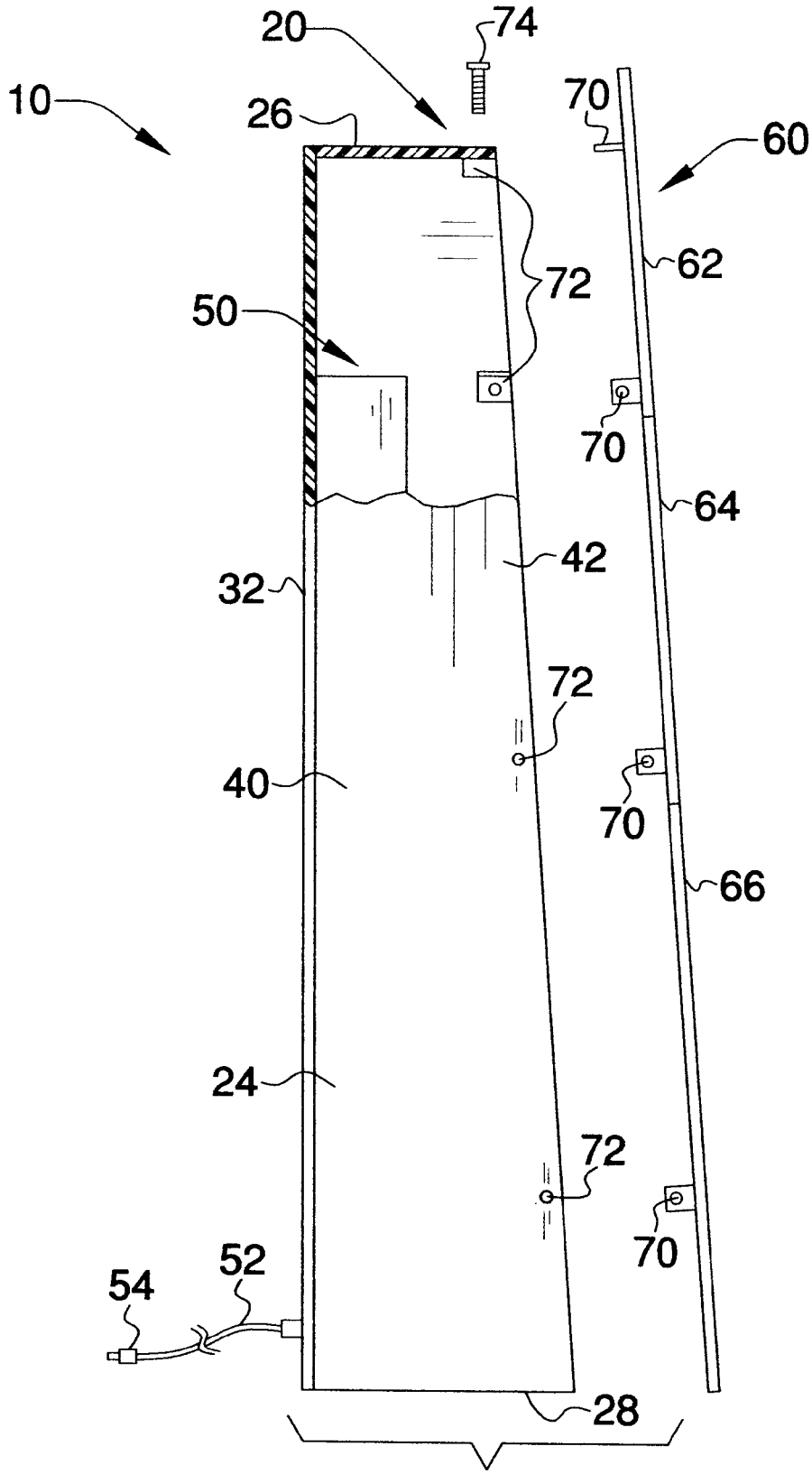
FIG. 3 is a side view of the present invention multi-purpose holiday display light box before the holiday indicia is installed.
Figure 4:
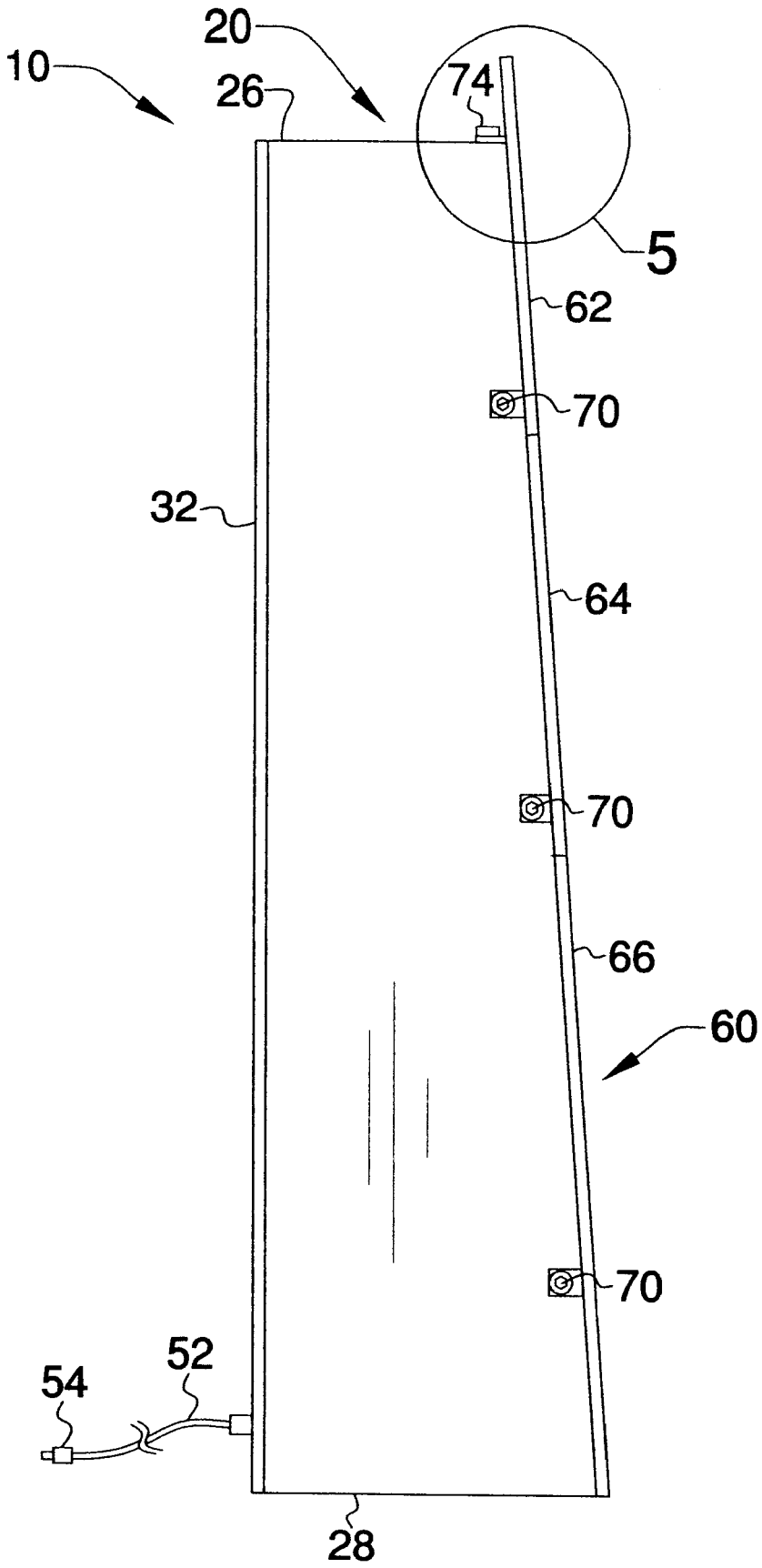
FIG. 4 is a side view of the present invention multi-purpose holiday display light box after the holiday indicia is installed.

Referring initially to FIG. 1, wherein a present invention multi-purpose holiday display light box 10 is shown. The holiday display light box 10 is constructed of an elongated box body 20, better shown in FIGS. 2,3 and 4, that has four side panels 22,24,26 and 28 and a bottom panel 32 forming a cavity 40 therein an open top 42.

Figure 2:
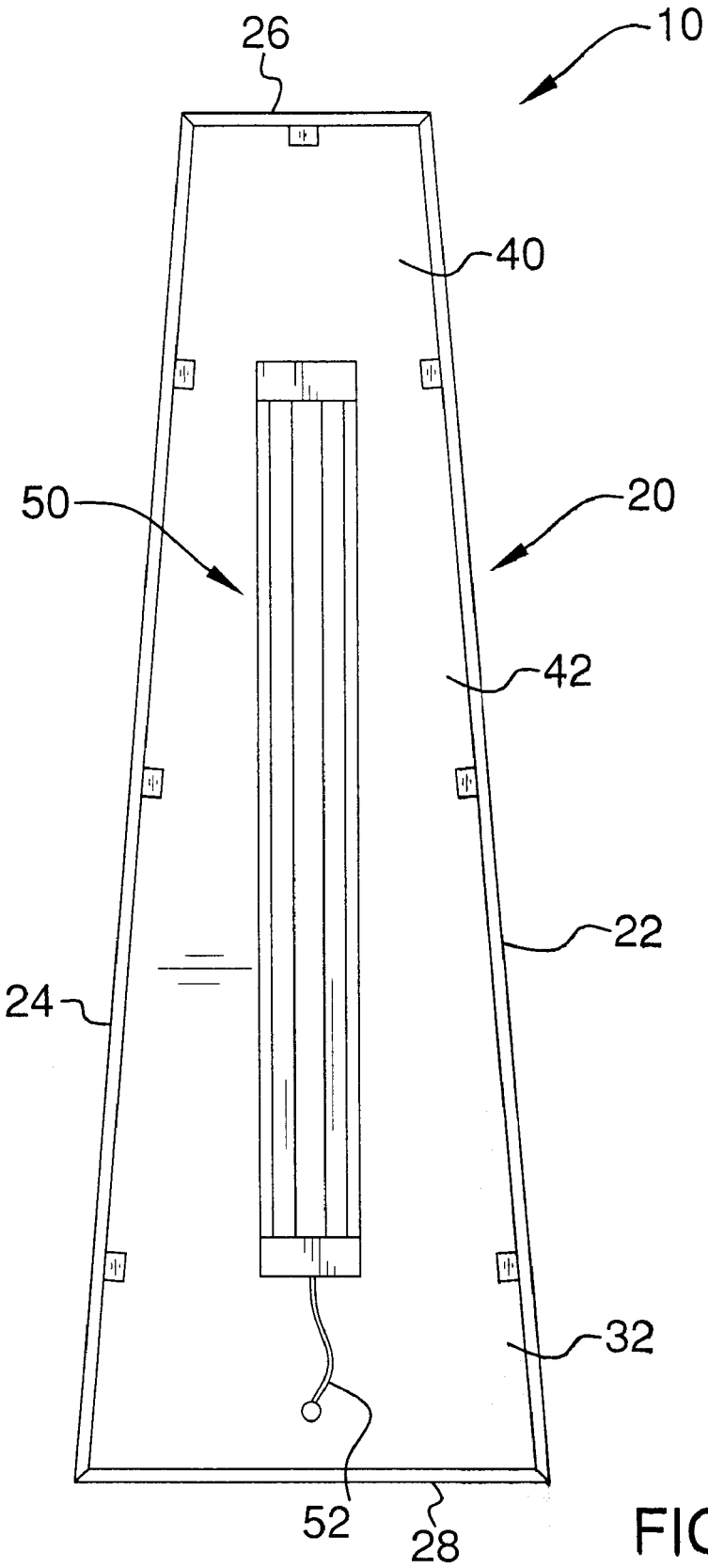
FIG. 2 is a front view of the present invention box body without the holiday indicia installed.

An illumination source 50, as shown in FIG. 2, is mounted in the cavity 40 on the bottom panel 32. A holiday indicia 60 that consists at least three sections, a head portion 62, an upper body portion 64 and a lower body portion 66 which are each formed of an at least partially light transmitting plastic material, i.e. a translucent material. The three sections 62,64, and 66 of the holiday indicia 60 are removably mounted to the box body 20 by mechanical means such as tabs 70 and screw holes 72. When the holiday indicia 60 is completely mounted, i.e. with all three sections, to the open top 42 of the box body 20, the open top 42 is completely concealed, i.e. the box body 20 is completely concealed or covered up by the holiday indicia 60. It should be also noted that an electrical cord 52 and an electrical plug 54 are also provided for the illumination box to work to illuminate the holiday indicia 60, such as the snowman shown in FIG. 1. A screw 74 is used to fasten the head portion 62 to the tab 70 through a screw hole 72.

Figure 5:
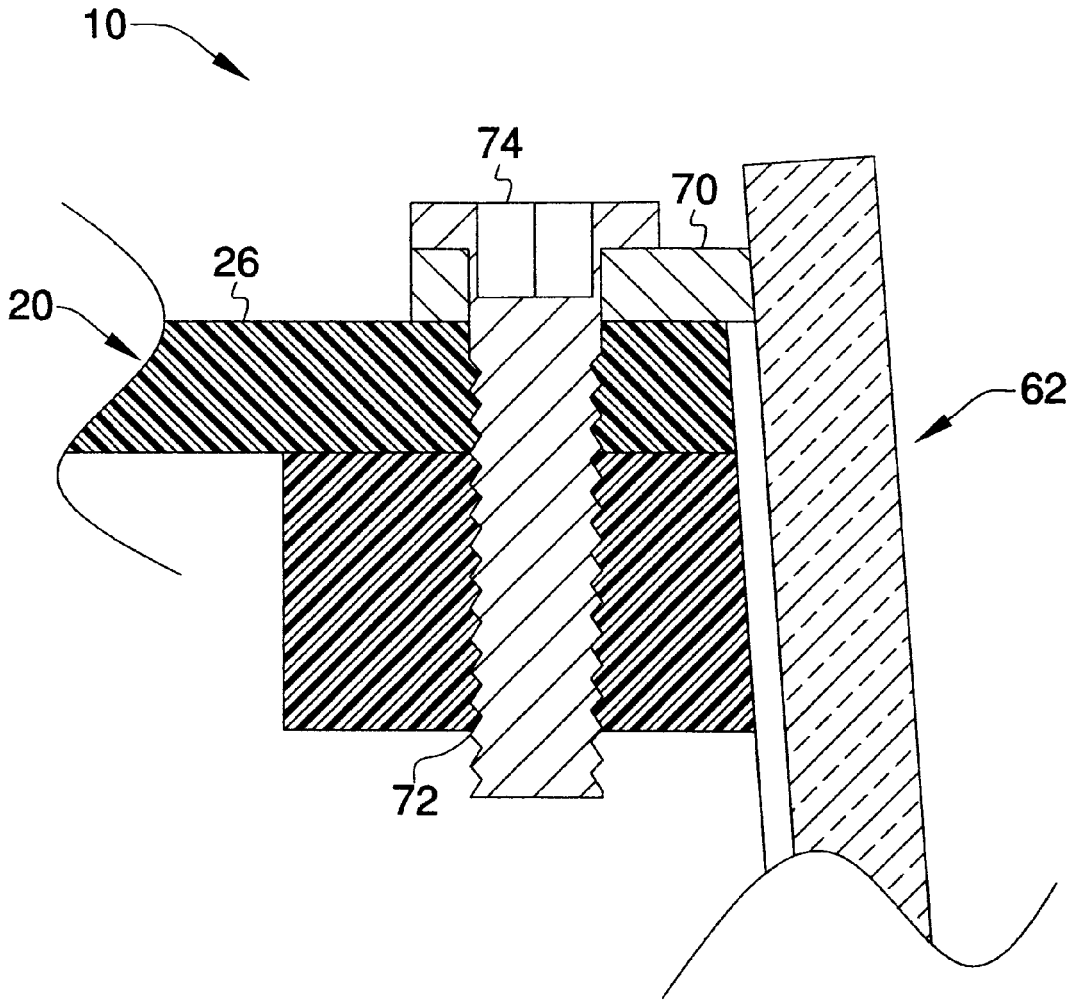
FIG. 5 is a partial, enlarged cross-sectional view illustrating how the holiday indicia is installed on the box body.

A detailed, enlarged, partial, cross-sectional view of the head portion 62, the mounted tab 70, the mounting screw 74, and the mounting hole 72 are also shown in FIG. 5.

Figure 6:
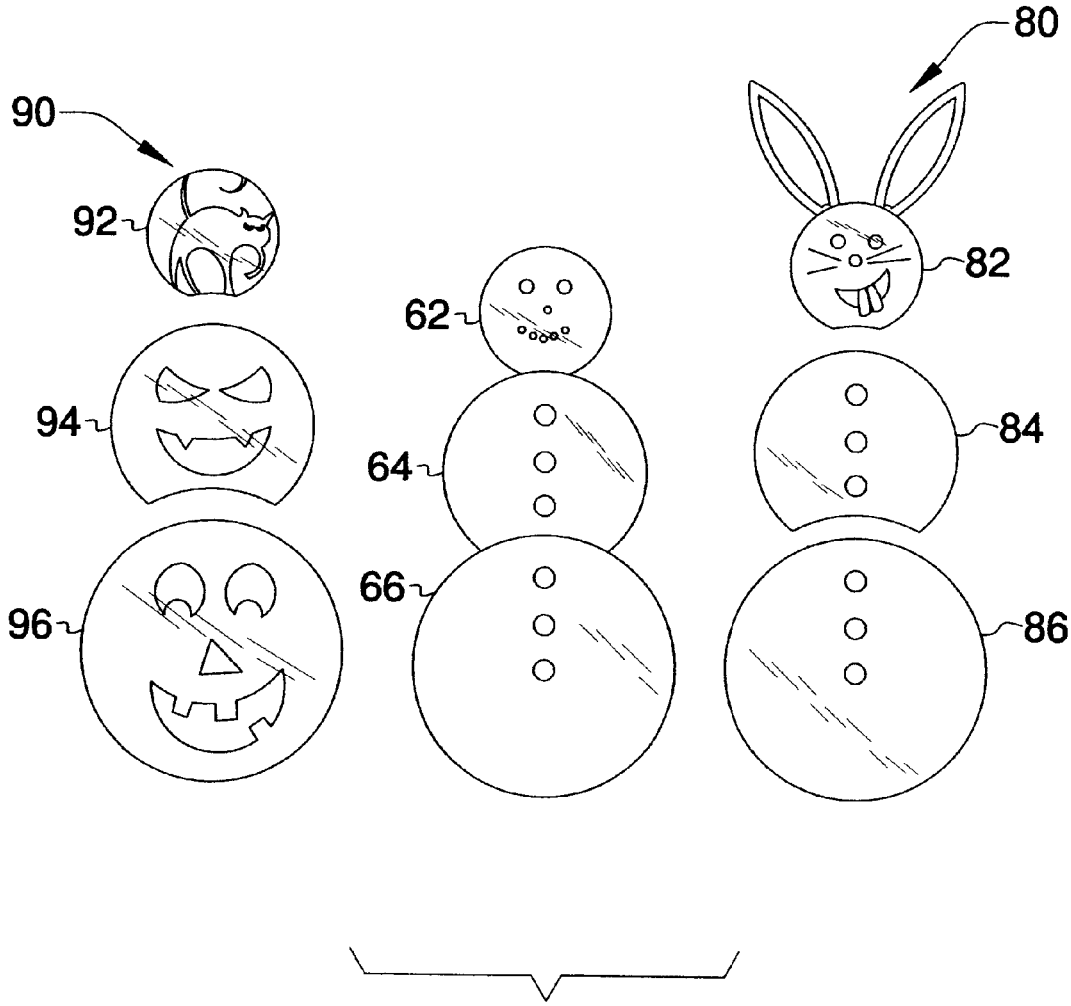
FIG. 6 is an illustration of various holiday indicia that can be used for various holidays.

Various holiday indicia's such as a snowman 60, a bunny 80, and a jack-o-lantern 90 are further shown in FIG. 6. Each shown in three separate sections of a head portion 62,82, and 92; an upper body portion 64, 84, and 94; and a lower body portion 66,86 and 96.

The present invention multi-purpose holiday display light box has therefore been amply described in the above descriptions and in the appended drawings of FIGS. 1-6.

While the preferred embodiments of the invention have been described above, it will be recognized and understood that various modifications can be made in the invention and the appended claims are intended to cover all such modifications which may fall within the spirit and scope of the invention.

What is claimed is:

1. A multi-purpose holiday display light box comprising;

an elongated box body having four side panels and a bottom panel forming a cavity therein and an open top;

an illumination source mounted in said cavity;

at least three sections of a holiday indicia arranged vertically representing a head portion, an upper body portion and a lower body portion wherein said lower body portion supports said upper body portion, and said upper body portion support said head portion; each of said at least three sections formed of an at least partially light transmitting plastic material and each is removably mounted to said box body to completely conceal said open top of the box body, said holiday indicia is selected form a the group consisting of a Santa Clause, a jack-o-lantern, a cartoon character and an animal.

2. The multi-purpose holiday display light box according to claim 1, wherein said box body is fabricated in plastic or wood.

3. The multi-purpose holiday display light box according to claim 1, wherein said illumination source is a fluorescent light tube and power supply to the tube.

4. The multi-purpose holiday display light box according to claim 1, wherein said holiday indicia is selected from the group consisting of a snowman, a bunny, a Santa Clause, a jack-o-lantern, and a toy soldier.

5. The multi-purpose holiday display light box according to claim 1 further comprising mechanical fastening means for removably fastening the holiday indicia to the box body.

6. The multi-purpose holiday display light box according to claim 5, wherein said mechanical fastening device consisting of mounting tabs, mounting holes, and mounting screws.

7. The multi-purpose holiday display light box according to claim 5, wherein said mechanical fastening device consists of hook-and-loop fastening strips.

* * * * *